US006598744B2

(12) United States Patent
Chen

(10) Patent No.: US 6,598,744 B2
(45) Date of Patent: Jul. 29, 2003

(54) GOLF BAG WITH AN EASY-TO-ASSEMBLE SUPPORTING DEVICE

(76) Inventor: Changfu Chen, 4F, No. 12, Alley 28, Lane 81, Sec. 7, Chung Shan N. Road, Taipei (TW)

( * ) Notice: Subject to any disclaimer, the term of this patent is extended or adjusted under 35 U.S.C. 154(b) by 0 days.

(21) Appl. No.: 09/848,447

(22) Filed: May 3, 2001

(65) Prior Publication Data

US 2002/0162762 A1 Nov. 7, 2002

(51) Int. Cl.[7] ..... A63B 55/04
(52) U.S. Cl. ..... 206/315.7; 248/96
(58) Field of Search ..... 206/315.7, 315.3; 248/96; 403/52, 59, 65, 326, 329, 330, 154, 164, 165, 101, 397

(56) References Cited

U.S. PATENT DOCUMENTS 1,887,838 A * 11/1932 Gunther ..... 206/315.7
2,732,581 A * 1/1956 Heck ..... 220/840
2,990,082 A * 5/1961 Boysen ..... 248/96
3,206,149 A * 9/1965 Labe ..... 248/96 X
3,580,533 A * 5/1971 Nordland ..... 248/96 X
5,048,777 A * 9/1991 Quellais ..... 248/96
5,096,148 A * 3/1992 Quellais et al. ..... 206/315.7 X
5,178,273 A * 1/1993 Igarashi ..... 206/315.7
5,261,562 A * 11/1993 Prout et al. ..... 220/771
5,339,951 A * 8/1994 Chen ..... 206/315.7
5,996,789 A * 12/1999 Suggs et al. ..... 206/315.3
6,152,642 A * 11/2000 Berhold et al. ..... 403/155
6,220,433 B1 * 4/2001 Kang ..... 206/315.7
6,227,503 B1 * 5/2001 Shiao Chen ..... 248/96
6,233,855 B1 * 5/2001 Alvern et al. ..... 40/299.01

* cited by examiner

*Primary Examiner*—Tri Mai
(74) *Attorney, Agent, or Firm*—Alan D. Kamrath; Rider, Bennett, Egan & Arundel

(57) ABSTRACT

A golf bag includes a bag, a head frame mounted to an open upper end of the bag, and two legs. The head frame includes two engaging portions each having two spaced blocks interconnected by a pin. An engaging member has a first upper end and a second end securely attached to an upper end of an associated leg. The first upper end of each engaging member includes a positioning notch for pivotally receiving the pin of an associated engaging portion. The positioning notch has an opening through which the pin is passable. The positioning notch has a diameter slightly larger than that of the pin and the opening has a width slightly smaller than the diameter of the pin.

10 Claims, 8 Drawing Sheets

A – A

GOLF BAG WITH AN EASY-TO-ASSEMBLE SUPPORTING DEVICE

BACKGROUND OF THE INVENTION

1. Field of the Invention

The present invention relates to a golf bag having an improved supporting device that can be easily assembled to the bag.

2. Description of the Related Art

A typical golf bag may stand in an upright manner or be supported in an inclined status by a supporting device attached to the golf bag. FIG. 1 of the drawings illustrates a conventional supporting device for a golf bag 11. Two engaging seats 12 are mounted to a rear side of an upper end of the golf bag 11 and have aligned pivot holes 13. The supporting device includes two supporting rods 14 each having an upper end having a pivot hole 15. A pin 16 is extended through the pivot hole 15 of each supporting rod 14 and the pivot hole 13 of the associated engaging seat 12. However, processing and formation of the engaging seats 12 and the supporting rods 14 are difficult. In addition, alignment of the pivot holes 15 of time supporting rods 14 with the pivot holes 13 of the engaging sears 12 is nor easy and is time-consuming. Furthermore, it was found that the pins 16 tend to deform after a period of time and thus cause malfunction of the supporting rods 14.

SUMMARY OF THE INVENTION

In accordance with a first aspect of the invention, a golf bag comprises:

a bag having an open upper end;

a head frame mounted to the open upper end of the bag, the head frame including two engaging portions each having two spaced blocks interconnected by a pin;

two legs each having an upper end and a lower end; and two engaging members each having a first end and a second end securely attached to the upper end of an associated said leg, the upper end of each said engaging member comprising a positioning notch for pivotally receiving the pin of an associated said engaging portion, the positioning notch having an opening through which the pin is passable.

In accordance with a second aspect of the invention, a golf bag comprises:

a bag having an open upper end;

a head frame mounted to the open upper end of the bag, a plate securely mounted to the head frame and including two engaging portions each having two spaced blocks interconnected by a pin;

two legs each having an upper end and a lower end; and two engaging members each having a first end and a second end securely attached to the upper end of an associated said leg, the upper end of each said engaging member comprising a positioning notch for pivotally receiving the pin of an associated said engaging portion, the positioning notch having an opening through which the pin is passable.

The positioning notch has a diameter slightly larger than that of the pin and the opening has a width slightly smaller than the diameter of the pin. In an alternative embodiment, two adjacent blocks of the engaging portions are integrally formed.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
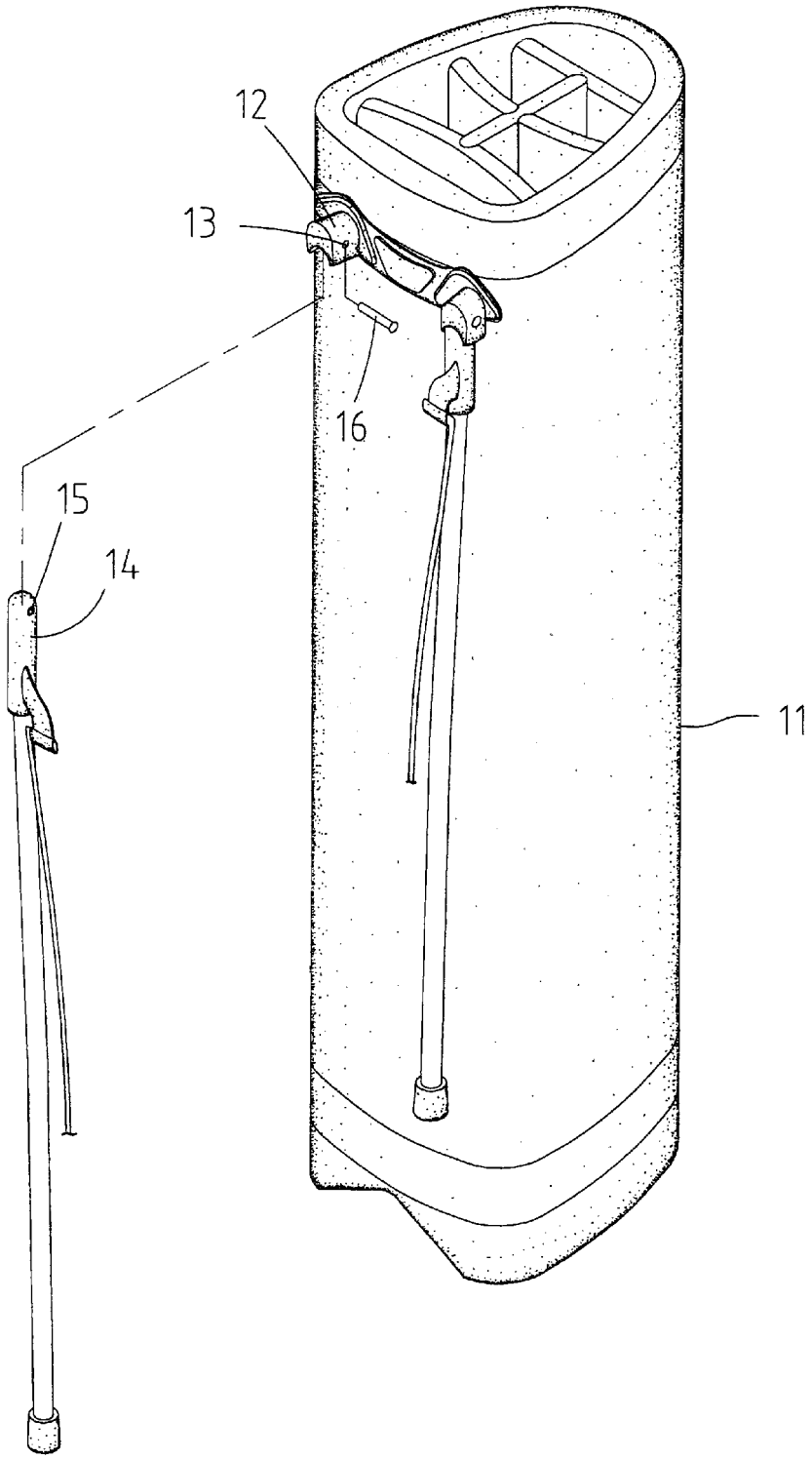
Fig. 1 PRIOR ART
FIG. 1 is a perspective view of a golf bag with a conventional supporting device.
Figure 2:
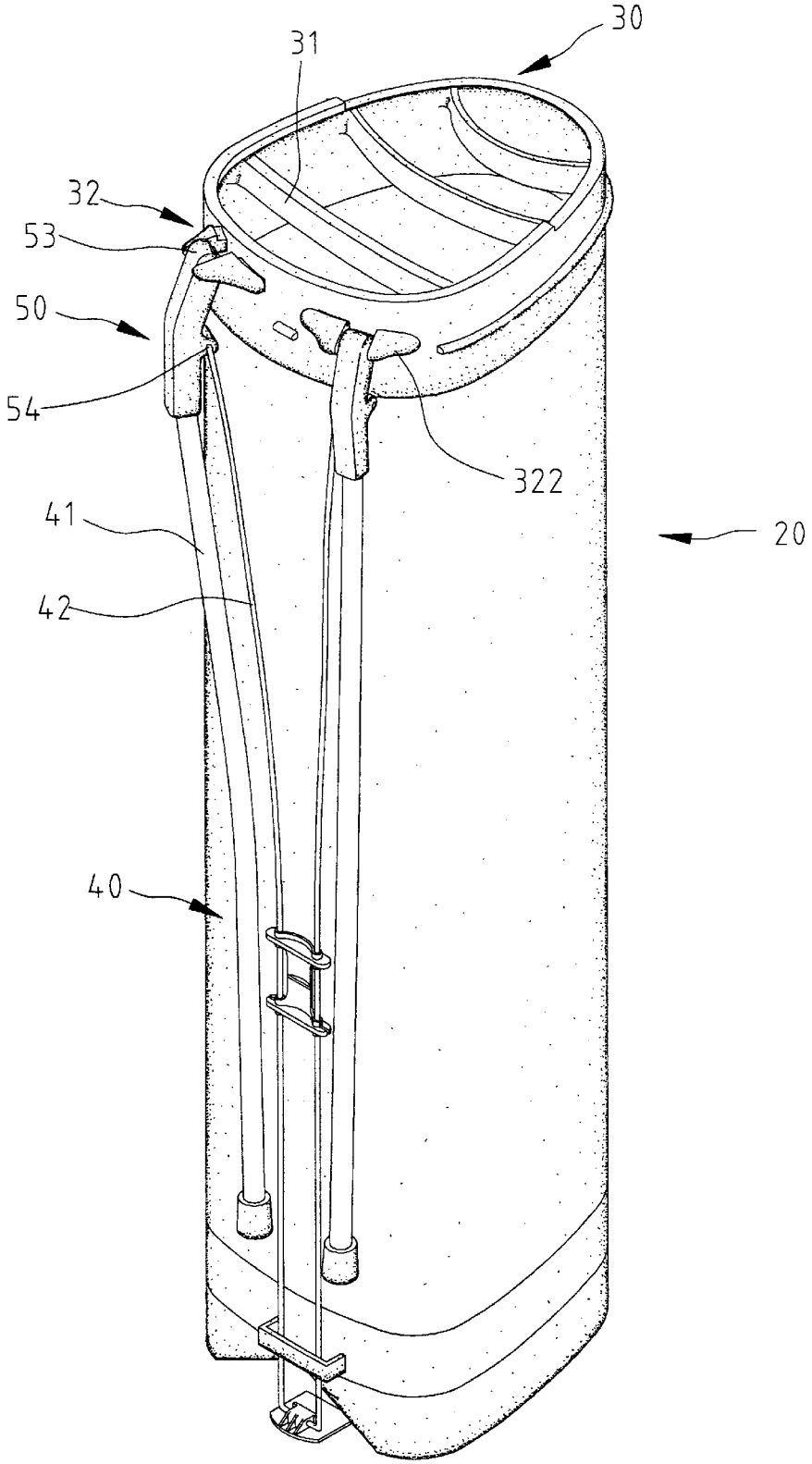
FIG. 2 is a perspective view of a golf bag with a supporting device in accordance with the present invention.
Figure 3:
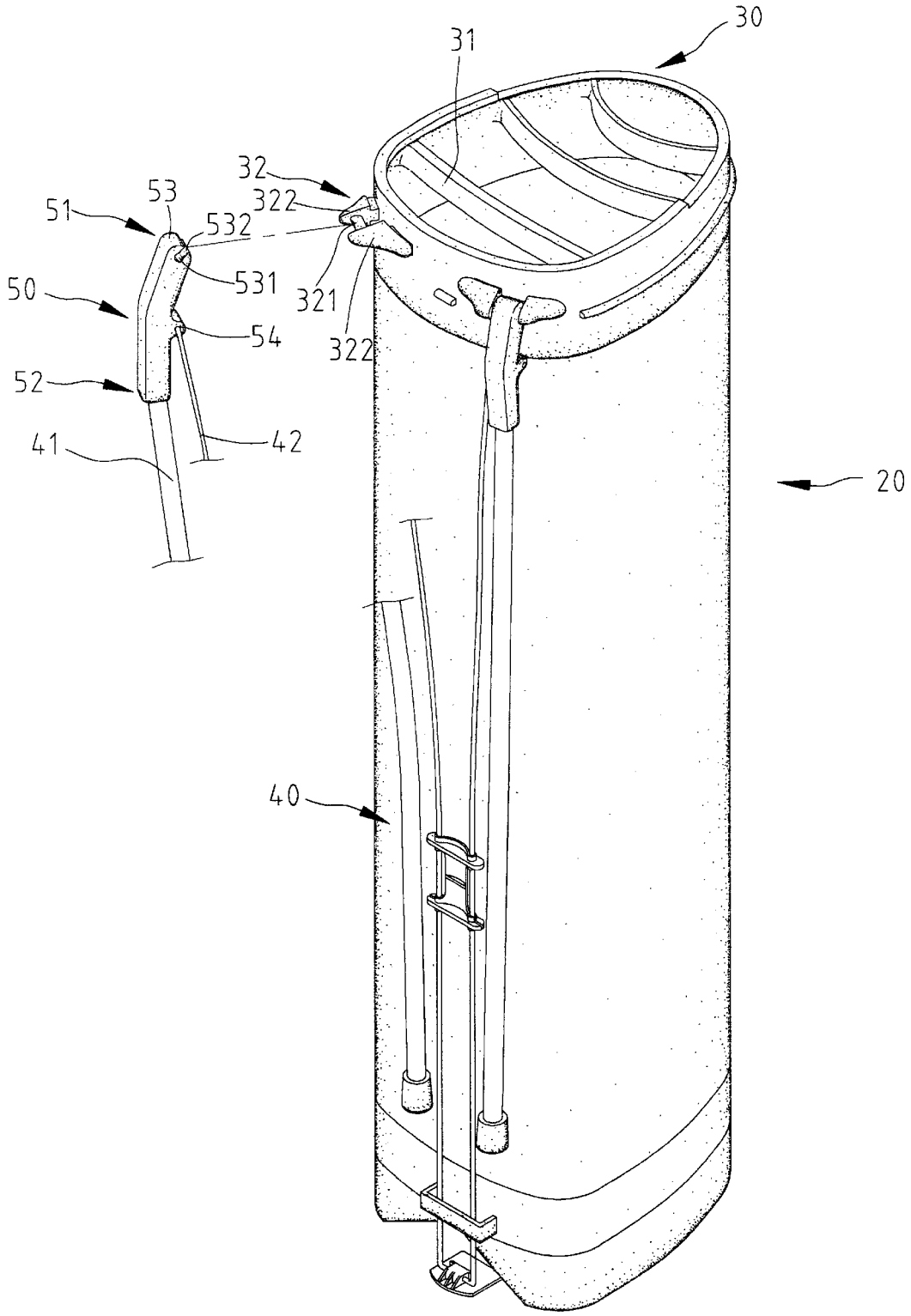
FIG. 3 is a perspective view, partly exploded, of the golf bag in FIG. 2.
Figure 4:
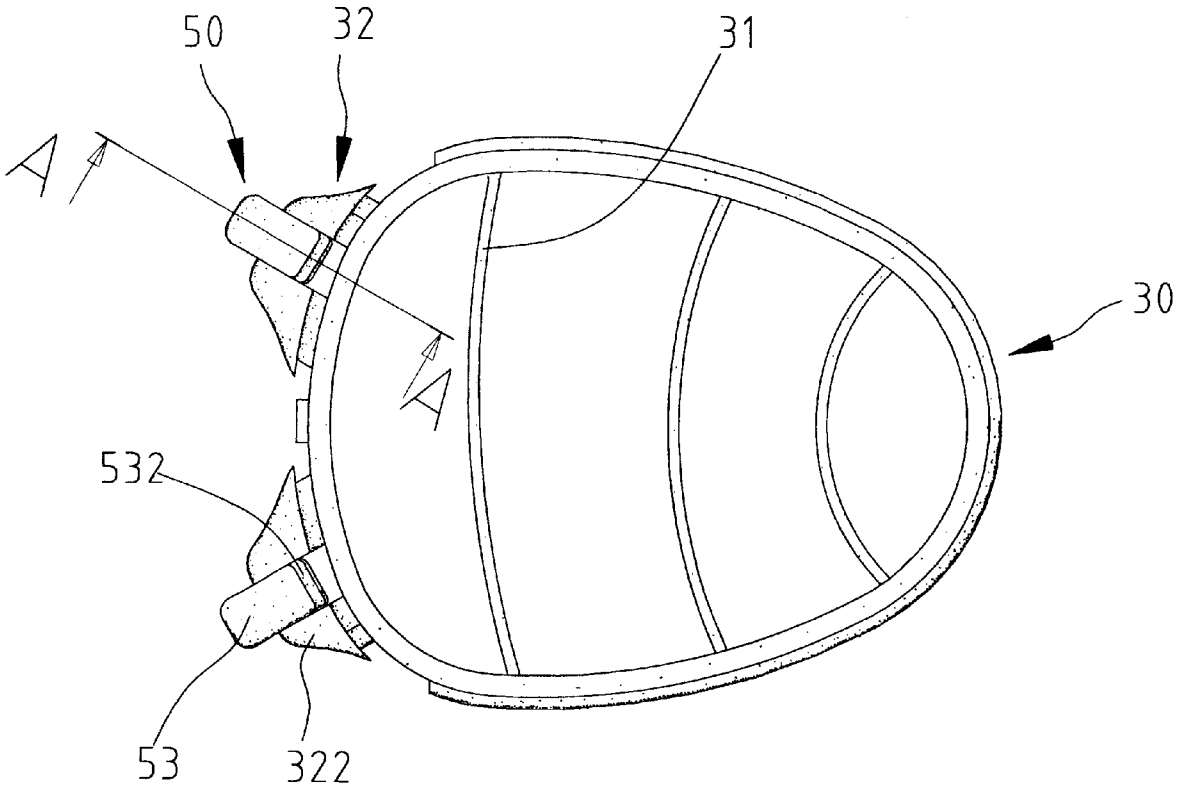
FIG. 4 is a top view of the golf bag in FIG. 2.
Figure 5:
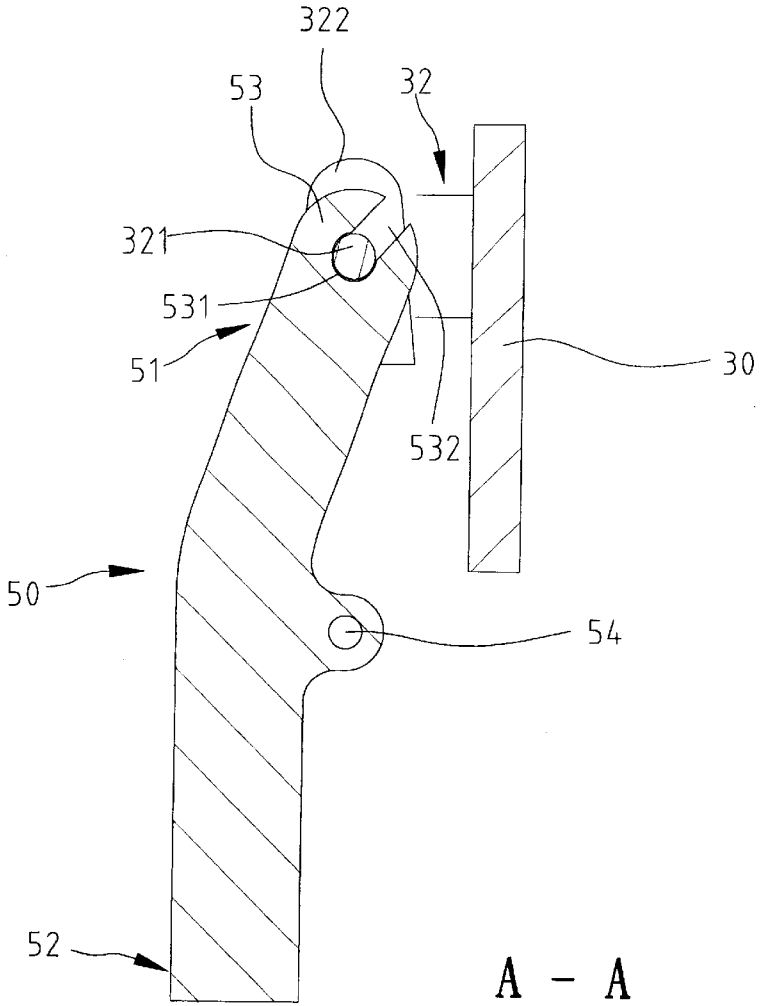
FIG. 5 is a sectional view taken along line A—A in FIG. 4.

Referring to FIGS. 2 through 8 and initially to FIGS. 2 through 5, a golfbag in accordance with the present invention comprises a bag 20, a head frame 30 mounted to an open upper end of the bag 20, and a supporting device 10. The head frame 30 comprises a plurality of partitioning bars or ribs 31 on an open top thereof for separating golf clubs placed into the bags 20. The head frame 30 further comprises two engaging portions 32 each including two spaced blocks 322 interconnected by a pin 321.

The supporting device 40 comprises two legs 41 each having an upper end to which an engaging member 50 is securely attached. Each engaging member 50 comprises a first end 51 with an engaging section 53, a second end 52 securely connected to the upper end of the associated leg 41, and a mediate portion 54 to which a tensioning rod or strip 42 is attached. Structure and operation of the tensioning strip 42 are conventional and therefore not described further. The engaging section 53 includes a positioning notch 531 having an opening 532, wherein the positioning notch 531 has a diameter slightly larger than that of the pin 321 and the opening 532 has a width slightly smaller than the diameter of the pin 321.

Figure 6:
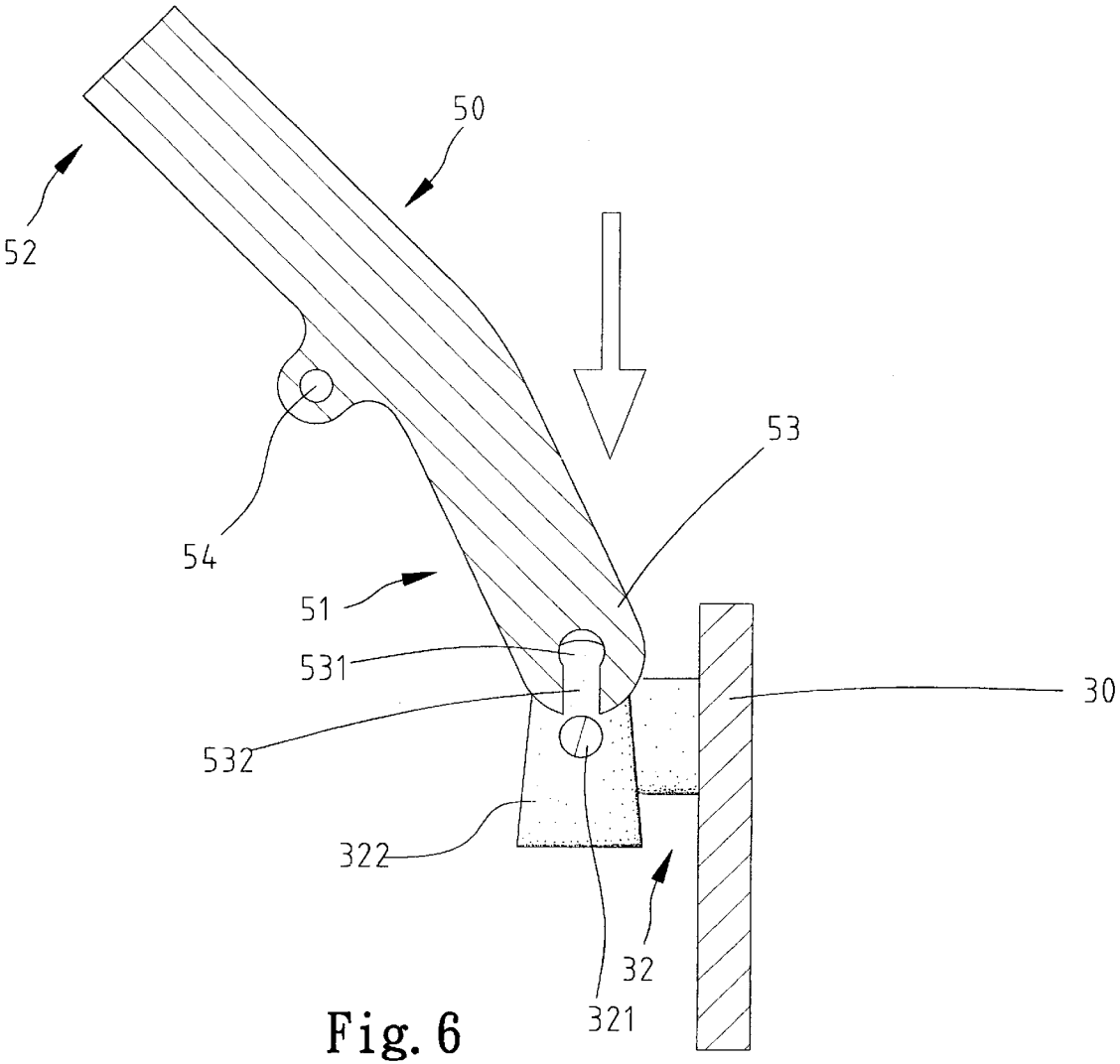
FIG. 6 is a sectional view similar to FIG. 5, illustrating assembly of the engaging member of the supporting device in accordance with the present invention.

Referring to FIG. 6, in assembly, the opening 532 of the positioning notch 531 of each engaging member 50 is placed above the pin 321 of the associated engaging portion 32, and the engaging member 50 is then moved downward to forcibly pass the pin 321 through the opening 532 until the positioning notch 531 engages with the pin 321. Thus, the engaging section 53 of each engaging member 50 is pivotally connected with the pin 321 of the associated engaging portion 32 without the risk of disengagement, as the positioning notch 531 has a diameter slightly larger than that of the pin 321 and the opening 532 has a width slightly smaller than the diameter of the pin 321. Thus, the engaging members 50 can be quickly and easily attached to the engaging portions 32 of the head frame 30 without the need of any other elements or parts. The manufacture cost and manufacture time are both saved.

Figure 7:
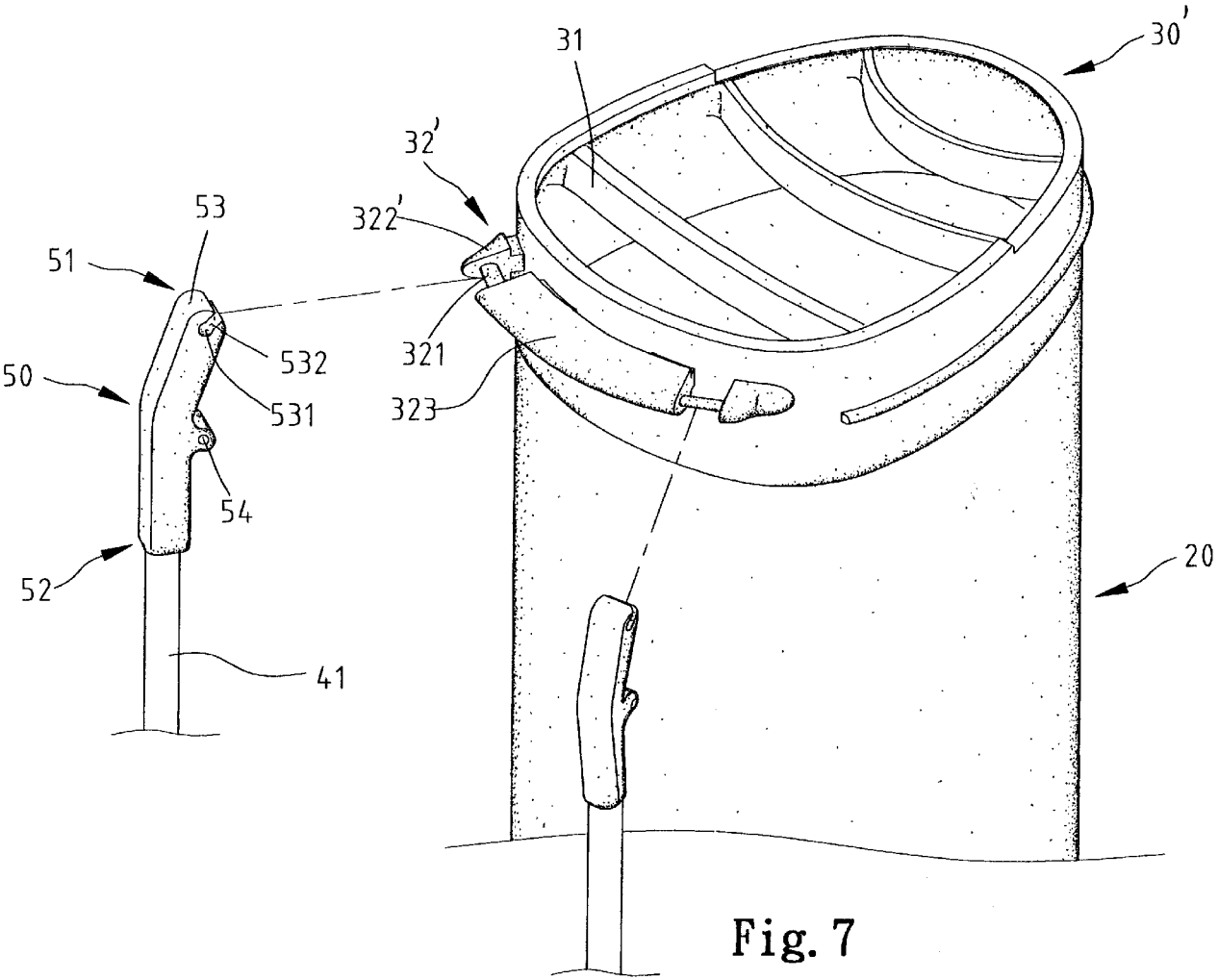
FIG. 7 is a partial perspective view, partly exploded, of a modified embodiment of the golf bag in accordance with the present invention.

FIG. 7 illustrates a modified embodiment of the invention, wherein two adjacent blocks 322' of the engaging portions 32' are integrally formed (see the integral part 323). Thus, the engaging portions 32' may withstand greater external force.

Figure 8:
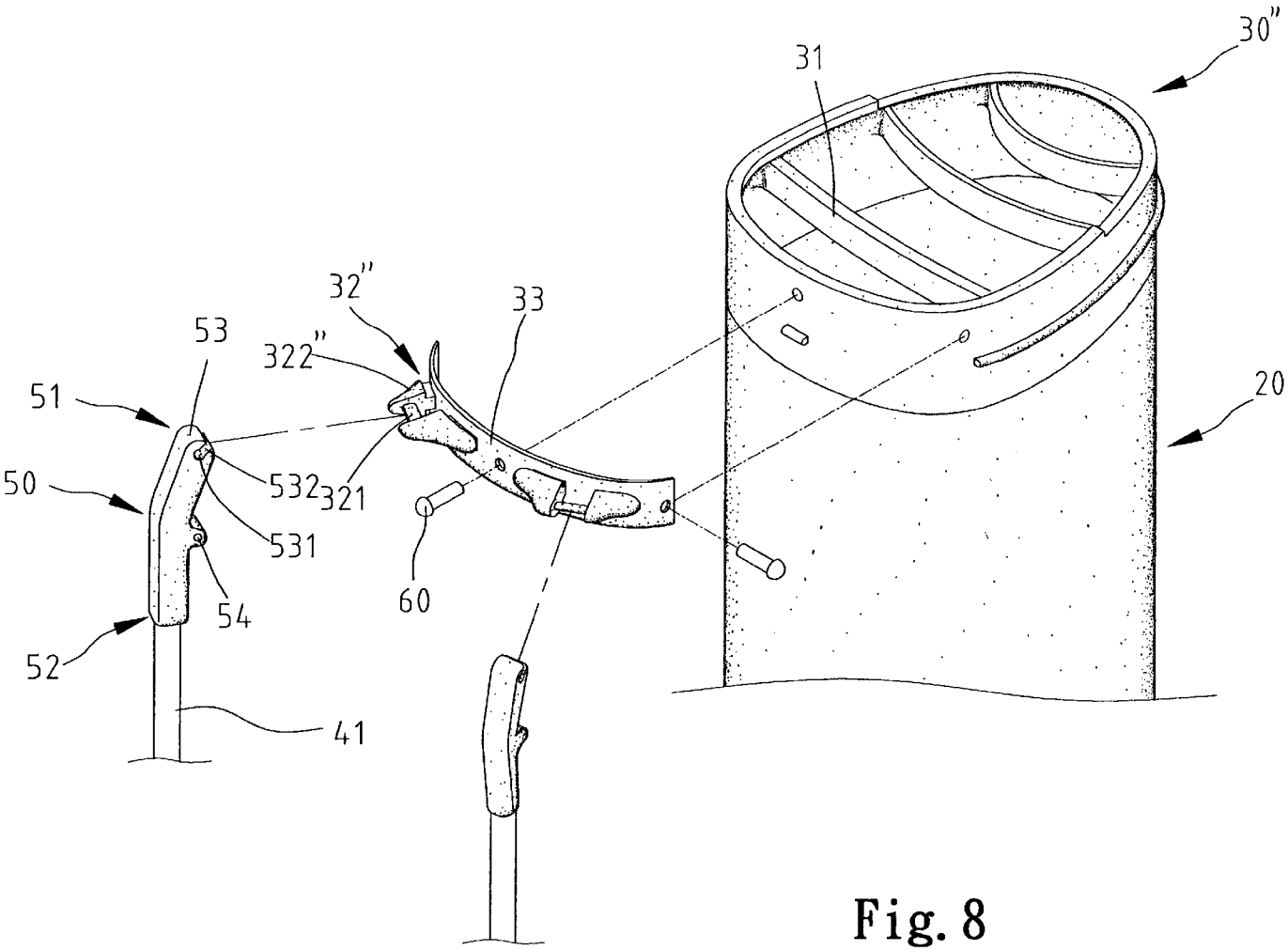
FIG. 8 is a partial perspective view, partly exploded, of another modified embodiment of the golf bag in accordance with the present invention.

FIG. 8 illustrates another modified embodiment of the invention, wherein the engaging portions 32" are formed on a plate 33 that is riveted to the head frame 30" by rivets 60. Thus, the supporting device in accordance with the present invention can be mounted to a head frame of the type without engaging portions 32".

According to the above description, it is appreciated that the engaging members 50 can be quickly and easily attached to the engaging portions 32" of the head frame 30" without the need of other elements or parts. The manufacture cost and manufacture time are both saved. It is achieved by the feature that the positioning notch 531 has a diameter slightly larger than that of the pin 321 and that the opening 532 has a width slightly smaller than the diameter of the pin 321. In addition, the engaging portions 32" may be formed on a plate 33 that is riveted to the head frame 30" by rivets 60. Thus, the supporting device in accordance with the present invention can be mounted to a head frame of the type without engaging portions 32".

Although the invention has been explained in relation to its preferred embodiment, it is to be understood that many other possible modifications and variations can be made without departing from the spirit and scope of the invention as hereinafter claimed.

What is claimed is:

1. A golf bag comprising:

a bag having an open upper end;

a head frame mounted to the open upper end of the bag, the head frame including two engaging portions, with the head frame and the two engaging portions being integrally formed with the two engaging portions each having two spaced blocks integrally interconnected by a pin;

two legs each having an upper end and a lower end; and two engaging members each having a first end and a second end securely attached to the upper end of an associated said leg, the first end of each said engaging member comprising a positioning notch for pivotally receiving the pin of an associated said engaging portion, the positioning notch having an opening through which the pin is passable, with the two engaging members being separately formed and independent from each other when the pin is pivotably received in the notch.

2. The golf bag as claimed in claim 1, wherein the positioning notch has a diameter slightly larger than that of the pin.

3. The golf bag as claimed in claim 2, wherein the opening has a width slightly smaller than the diameter of the pin.

4. The golf bag as claimed in claim 1, wherein the opening has a width slightly smaller than a diameter of the pin.

5. The golf bag as claimed in claim 1, wherein two adjacent said blocks of the engaging portions are integrally formed.

6. A golf bag comprising:

an bag having an open upper end;

a head frame mounted to the open upper end of the bag, a plate securely mounted to the head frame, with the plate including two engaging portions, with the plate and the two engaging portions being integrally formed with the two engaging portions each having two spaced blocks integrally interconnected by a pin;

two legs each having an upper end and a lower end; and two engaging members each having a first end and a second end securely attached to the upper end of an associated said leg, the first end of each said engaging member comprising a positioning notch for pivotally receiving the pin of an associated said engaging portion, the positioning notch having an opening through which the pin is passable, with the two engaging members being separately formed and independent from each other when the pin is pivotably received in the notch.

7. The golf bag as claimed in claim 6, wherein the positioning notch has a diameter slightly larger than that of the pin.

8. The golf bag as claimed in claim 7, wherein the opening has a width slightly smaller than the diameter of the pin.

9. The golf bag as claimed in claim 6, wherein the opening has a width slightly smaller than a diameter of the pin.

10. The golf bag as claimed in claim 6, wherein two adjacent said blocks of the engaging portions are integrally formed.

* * * * *